US005519893A

United States Patent [19]

Silver

[11] Patent Number: 5,519,893

[45] Date of Patent: May 28, 1996

[54] INVISIBLE ENGAGEMENT SYSTEM FOR A BELT

[76] Inventor: Samuel Silver, 3600 Mystic Pointe Dr., #606, North Miami Beach, Fla. 33180

[21] Appl. No.: 395,919

[22] Filed: Feb. 28, 1995

[51] Int. Cl.[6] ..... A41F 9/00

[52] U.S. Cl. ..... 2/321; 2/322; 24/182

[58] Field of Search ..... 2/321, 322, 336, 2/338, 311, 312; 24/182, 580, 581

[56] References Cited

U.S. PATENT DOCUMENTS

| | | | |
|---|---|---|---|
| D. 141,753 | 7/1945 | DuBois | 2/321 |
| 446,186 | 2/1891 | Leck . | |
| 764,999 | 7/1904 | Gallert | 2/321 |
| 1,155,187 | 9/1915 | Woodruff | 2/321 |
| 1,341,406 | 5/1920 | Ade | 2/321 |
| 1,345,750 | 7/1920 | DeBeaumont | 2/321 |
| 1,371,448 | 3/1921 | Soar | 2/321 |
| 2,423,668 | 7/1947 | Wiethorn | 2/322 |
| 2,575,952 | 11/1951 | Goff . | |
| 2,943,332 | 7/1960 | Meeker . | |
| 3,112,496 | 12/1963 | Dritz . | |
| 3,501,775 | 3/1970 | Demers et al. . | |
| 3,591,866 | 7/1971 | Jensen | 2/321 |
| 4,179,755 | 12/1979 | Clark | 2/322 |
| 4,369,529 | 1/1983 | Yahata . | |
| 5,318,505 | 6/1994 | Sou | 2/338 |

*Primary Examiner*—C. D. Crowder
*Assistant Examiner*—Gloria Hale
*Attorney, Agent, or Firm*—Robert M. Schwartz; Edward I. Mates

[57] ABSTRACT

A flexible belt has a single male engagement member at one longitudinal end portion and a plurality of closely spaced female engagement members at its other longitudinal end portion. A belt keeper is supported near one longitudinal end portion of the belt to align the longitudinal end portions transversely when the single male engagement member engages one of the closely spaced female engagement members when the belt is tightened against the waist of a wearer. The belt composed of an inner lamina and an outer lamina to support a base member for each engagement member and for the belt keeper is constructed and arranged to hide from view the engagement members and the belt keeper when the belt is tightened around the waist and is free of any bulk increasing mass or localized folding that increases the bulkiness of the belt. If the belt has a buckle, the latter is used for belt ornamentation rather than connecting the longitudinal end portions of the overlapping end portions of the belt.

6 Claims, 4 Drawing Sheets

INVISIBLE ENGAGEMENT SYSTEM FOR A BELT

BACKGROUND OF THE INVENTION

1. Field of the Invention

This invention relates to flexible belts for supporting pants, trousers, skirts and the like against the waist of a wearer.

2. State of the Prior Art

For many years, flexible belts have been provided with buckles having elongated tongues constructed and arranged to project through a chosen one of a series of longitudinally spaced openings in the free end of the belt, depending on the size of the wearer. Some belt buckles have been developed that eliminate the need for perforations, which enhanced the appearance of the end portions of the belt. However, the continued presence of belt buckles left the belts with a relatively thick and bulky end portion where the belt end portion was attached to the buckle. Also, whenever such belts were adjusted in length to accommodate a change in girth of the wearer, a mark extending transversely of the belt caused by the prior position of the buckle along the length of the belt disfigured the belt across its width where the prior position of the buckle applied pressure across the width of the belt, whenever the position of the buckle along the length of the belt was changed to accommodate for a change of girth of the wearer.

Eliminating a buckle from prior art belts left the modified belts with attachment means exposed to view, so that the appearance of some belts left something to be desired because of exposed belt openings and other attachment means that remained exposed to view when the buckles were eliminated. One solution to this problem was to provide belts with additional structure to hide the attachment means and/or belt openings from view. This additional structure increased the bulkiness of the belt and its cost of fabrication.

Other length-adjustable belts had openings only on the back side of the belt to avoid the exposure of the adjustment means from prior art belts. The latter type required at least two pairs of interfitting male and female attachment means to align the overlapping belt ends. These and other structural features of prior art belts made them both more expensive and more difficult to fabricate.

Prior art adjustable belts lacked adequate precision of adjustability of the belt length around the waist of a wearer in response to gain or loss of weight of men and/or women and in response to growth of children wearing belts. Also, ornamentation of prior art belts was limited to the buckle attachments available. Also, many prior art belts included fillers which made it difficult to adjust the shape of the belts to that of the wearers because the filler material limited the flexibility of the belt and increased their bulk.

Another drawback of prior art belts was that they limited inventory selection. An inventory investment for a particular style of belt required a large investment to insure an adequate variety of belt sizes in stock. If a smaller number of sizes were required to have a complete inventory of belts for any style, the same investment could be used to insure a larger variety of belt styles in stock at either the retail or manufacturer level.

The following patents were found in a novelty search performed prior to the preparation of this specification.

U.S. Pat. No. 446,186 to Leck, issued Feb. 10, 1891, shows a lady's belt having overlapping end portions. One end portion has openings B extending through its entire thickness. A male attachment member C extends from the other end portion of the belt through the entire length of one of the openings B determined by the size of the waist of the wearer, and has its unattached end exposed beyond the one end portion of the belt when the belt is closed around the waist of the wearer. It is thus necessary for Leck to add a flexible flap D to the belt to shield the openings B and member C from outside view, thereby complicating the belt structure.

U.S. Pat. No. 1,158,187 to Woodruff, issued Sep. 28, 1915, shows a belt extending through a series of loops 1 spaced around the inner surface of a pair of pants with overlapping end portions. One of the overlapping end portions has a plurality of knobs or conical heads 4 selectively attached to a plurality of corresponding spring sockets 5 secured to the other end of the belt to adjust the length of the belt. This belt is supported on loops entirely within the trousers, which makes access to the belt to adjust its length difficult.

U.S. Pat. No. 1,345,750 to Beaumont, issued Jul. 6, 1920, shows a flexible belt 10 having a pair of studs 12 extending from an enlarged shoulder 15 selectively through a series of spaced pairs of apertures 16 in such a manner that the outer ends of the studs and some of the apertures 16 are exposed as shown in FIG. 1 when the belt is tightened around the waist of the wearer. The requirement to attach a pair of male connection members such as studs 15 to a pair of female attachment members such as apertures 16 to align the ends of the belt makes both the construction and operation of the belt more complex than if the belt had only a single stud to aperture connection to overlap the belt ends properly. However, a single stud to aperture connection fails to maintain the belt ends in proper transverse alignment.

U.S. Pat. No. 2,565,952 to Goff, issued Nov. 20, 1951, shows a flexible belt B having a pair of tubing elements 11 and 17, the former of which supports a metal strip having a U-shaped bent portion to engage a square-shaped opening 9 and the latter having hook members 15 engaging stop elements 14 to adjust the belt length. Both the hook members 15 and stop elements 14 are arranged in pairs which must be engaged simultaneously, thereby increasing the difficulty of aligning the belt during its adjustment. Tubing elements 11 and 17, necessary in the Goff structure, provide structural complications that would be better eliminated if the belt structure would make these elements unnecessary.

U.S. Pat. No. 2,943,332 to Meeker, issued Jul. 5, 1960, shows a belt free of visible attachment holes that is constructed and arranged to fold over one end of the belt to make that end bulky. A localized bulky portion detracts from the appearance of the belt. An ornamental device 17 provided in the vicinity of the bulky portion draws attention to the bulky portion.

U.S. Pat. No. 3,112,496 to Dritz, issued Dec. 3, 1963, shows a belt with corrugated fastening means 4,5 that requires a visible U-shaped clip 6 to keep the belt in a locked position when its end portions 2 and 3 overlap and contact one another at several spaced lines of attachment. Pressure sensitive adhesive 11 may be used to further secure corrugated fastening means 4,5 to the belt, and end portions 12 of the corrugations may have adhesive to strengthen the bond.

U.S. Pat. No. 3,501,775 to Demers et al., issued Mar. 24, 1970, shows a belt having no buckle or stitching exposed to the outside thereof. This patent uses adhesive material that forms joints 36 to conceal stitching of thread or other connecting means 34 by preventing the latter from extending to the outer surface of the belt. This patent has a folded tongue 22 with holes 24 extending through its entire thickness to adjust the belt length. Folding tongue 22 is used to cover holes 24 and stitching 34 imparts bulkiness to the belt.

U.S. Pat. No. 4,369,529 to Yahata, issued Jan. 25, 1983 shows a complicated buckle 1 for attaching overlapping end portions of a belt 2 beneath an ornamental cover for the buckle. A free end of the belt has a series of spaced holes 7 that extend only a portion of the belt thickness from a rear surface of the belt near its free end to receive a projection 8 from an element pivoted to buckle 1 within one of the spaced holes 7. Projection 8 extends from base 3. The latter is pivoted to buckle structure 1 to clamp a free end of the belt beneath an ornamental cover 4 of the belt to the latter. In this patent, an adjusting belt 6 is attached to buckle 1 through a pivotable attaching plate 5. This construction requires that a buckle be included where the ends of the belt overlap.

BRIEF DESCRIPTION OF THE INVENTION

The invention relates to a belt of simple structure having a front lamina facing away from the waist of a wearer and a rear lamina facing toward the waist and a pair of longitudinal end portions constructed and arranged to overlap one another along a region of overlapping. One of the longitudinal end portions has a plurality of closely spaced female attachment members and the other longitudinal end portion has a single male attachment member constructed and arranged to engage any one of said female connection members. The single male attachment member is the only male attachment member of the belt and is engageable with any one of the female attachment members to form a single attachment pair. The belt also includes a keeper to keep the longitudinal end portions in transverse alignment. All of the attachment members are hidden from view when the belt is wrapped around the waist of a wearer and its longitudinal end portions properly overlapped. The belt is free of buckles and any bulky regions when the end portions overlap by virtue of the simple belt construction that enables the belt to be closely fitted to the waist of the wearer, even over a wide range of waist sizes, without increasing the total thickness of the belt, particularly in its overlapping region.

A first embodiment of this invention comprises a flexible belt adjustable in length having a first longitudinal end portion (otherwise called its male end portion) with a single male attachment member in the form of a thin metal tongue having a base attached to said first longitudinal end portion between its lamina and extending longitudinally in closely spaced relation to the outer surface of the belt in position to interengage with any one of a series of female attachment members defining longitudinally spaced, flat slots such as a series of closely spaced staple-like members fixed to a second longitudinal end portion of the belt to support bridge members closely spaced along the inner surface of the female end portion of the belt opposite to the male end portion that supports the thin metal tongue so that the tongue fits snugly in the tongue-receiving slot formed at the space between any of the bridge members and the adjacent belt surface without unduly increasing the overall thickness of the belt in the end regions where the belt end portions overlap. When in operating condition, the tongue extends away from the inner lamina at one end of the belt to engage the female attachment members that extend from the inner lamina toward the waist of the wearer at the other end of the belt.

In other embodiments of this invention, the set of female attachment members comprise a set of closely spaced holes, preferably of oblique cross-section, that extend through the thickness of the belt and terminate at the major surface of the belt that faces the belt wearer when the end portions overlap. Only a single male member or pin, also preferably of oblique cross-section conforming to the cross-section of the holes, extends inward toward the waist of a person from the opposite male end portion of the belt from that containing the closely spaced female members comprising the holes that receive the single pin-like male member.

A keeper, preferably of U-shaped cross-section, fixed to the male end portion of the belt that contains the pin is only slightly larger than the cross-section of the end belt portion to enable the apertured female end portion containing the closely spaced female members to pass through the keeper and enables an engagement of the single pin to any convenient hole to connect and align the belt ends without requiring simultaneous engagement between at least a pair of male members with at least a pair of spaced female members as in the prior art.

The relatively simple structure of the belt eliminates the need for the relatively bulky portions required in the prior art. Furthermore, this invention does not require the use of buckles to fasten the overlapping end portions together. If ornaments are desired for ornamental purposes, they can be fitted to the belt either in the vicinity of or in circumferentially spaced relation to the overlapping end portion, as desired, and are not needed for attachment.

Simple attachment means attaches the longitudinal tongue to the belt at one longitudinal end portion thereof and the staple-like female attachment members of the first embodiment to the belt at its other longitudinal end portion thereof, and simple fabrication techniques that do not make the belt bulky are all that are needed to provide the belts of this invention with the male and female attachment means of the other embodiments.

The outer and inner lamina of the belt are defined by the positions the lamina occupy when the belt is unfolded. The outer lamina is located away from the waist of the wearer and the inner lamina faces the waist of the wearer. However, when the belt is tightened around the waist of the wearer, in order to insure that the attachment members are hidden from outside view-when the belt is worn, in the first embodiment the single male attachment member has a base embedded at or near an interfacial surface between the lamina and the male attachment member is located exterior of the male end of the belt when the latter is tightened. Also, each female attachment member has a base embedded at or near an interfacial surface of the belt between the inner and outer lamina and each female attachment member is located interior of the inner lamina at the female end of the belt. In order to hide the attachment members from view, the female end overlaps the male end when the belt is closed.

In the second embodiment, the pin that serves as the single male attachment member has a base that is embedded at or near the interfacial surface of the lamina and extends toward the waist of the wearer. In order to hide the attachment members of this embodiment from view when the belt is closed, the male end overlaps the female end.

The belt keeper is preferably composed of a U-shaped metal member that has a base embedded at or near the interfacial surface between the lamina at one end belt portion that overlaps the other end belt portion when the belt is closed, a horizontal cross piece that extends toward the waist of the wearer to slidably support the lower edge of the belt and a vertical arm that balances the other belt end portion and holds it against the first end portion when the belt is closed around the waist of a wearer.

The simplicity of the attachment means of either embodiment of the invention makes it possible for the first embodiment to adjust the length of the belt by less than one-half inch adjustments and even as little as 5/16 inch adjustments in the first embodiment and by as little as one-quarter inch adjustments in the other embodiments. As a consequence, belt inventories can be reduced by making different sizes of belts available over wider ranges than prior art belts. The latter usually were capable of mid-sizes every two inches apart with five holes one inch apart provided for each sized belt in the inventory, two on each side of a center hole for the belt. For example, an inventory of men's belts suitable for waists ranging from 30 to 43 inches that formerly required belts of 30, 32, 34, 36, 38, 40 and 42 inches in seven different inventory sizes has been replaced with three different sizes of belts, namely, small ranging from 30 to 35 inches, medium ranging from 34 to 39 inches, and large ranging from 38 to 43 inches. Also, an inventory of women's belts to accommodate women's waists ranging from 26 to 39 inches that formerly required sizes 26, 28, 30, 32, 34, 36 and 38 inches, also requiring seven inventory sizes, now has been replaced with three different belt ranges (26 to 31, 30 to 35, and 34 to 39 inches).

The benefits from this invention will be better understood from a description of certain embodiments of this invention that follows.

BRIEF DESCRIPTION OF THE DRAWINGS

In the accompanying drawings where like reference numbers refer to like structural elements.

DESCRIPTION OF PREFERRED EMBODIMENT

Figure 1:
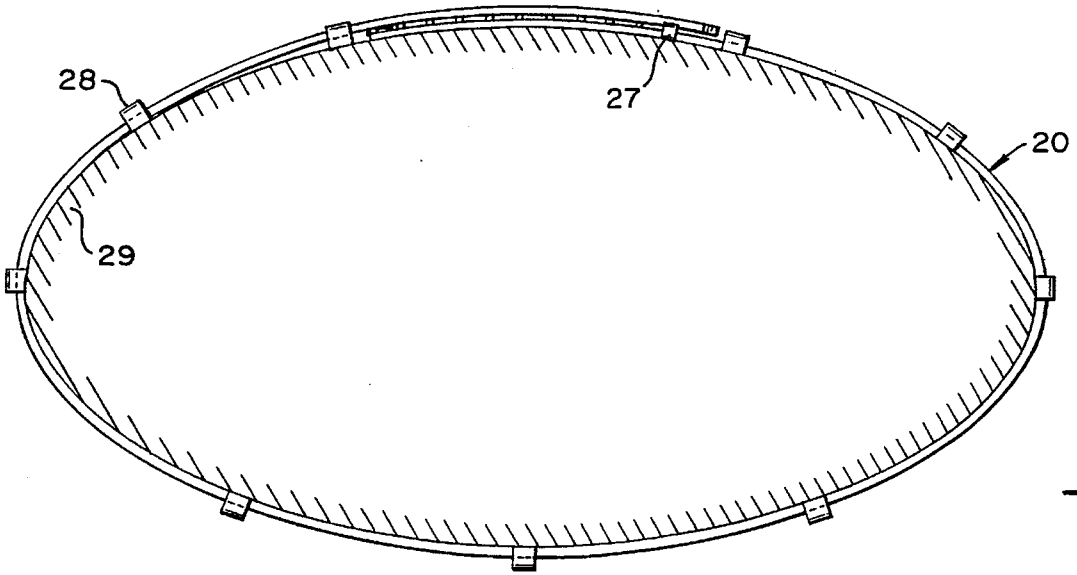
FIG. 1 is a perspective view of an embodiment of a belt according to this invention fitted around the body of a wearer.
Figure 2:
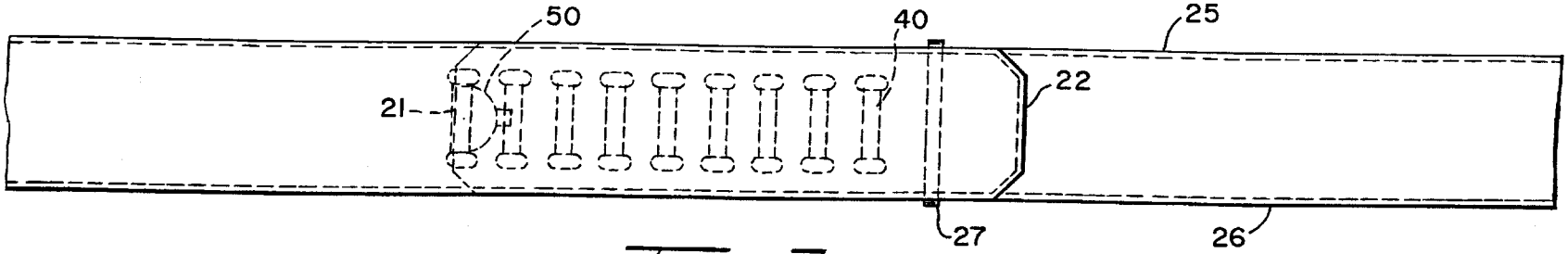
FIG. 2 is a partial frontal view of the overlapping end portions of the belt of FIG. 1 with a single male attachment member and a plurality of Closely spaced female attachment members (shown in phantom) fixed to the opposite longitudinal end portions of the belt.

The drawings depict illustrative embodiments of this invention. A first embodiment of belt of this invention is shown generally by the reference numeral 20 and comprises a first end portion 21 and a second end portion 22 at the opposite longitudinal end portion of the belt from first end portion 21. In the first embodiment of this invention, belt 20 has an outer lamina 23 attached by sewing and/or adhesive means to an inner lamina 24. The terms "outer" and "inner" refer to the positions of the lamina relative to the waist of a wearer when the belt is open and ready to be locked around the waist of a wearer. Belt 20 has an upper edge 25 and a lower edge 26.

A belt keeper 27 surrounds longitudinal end portion 22 and provides clearance to permit a tight, sliding fit for first longitudinal end portion 21 so that first and second longitudinal end portions 21 and 22 overlap around a wearer's waist. The portion of belt 20 circumferentially between the overlapping longitudinal end portions is supported by a series of circumferentially spaced pants or skirt loops 28 sewn or otherwise attached to the perimeter of a pair of pants or a skirt 29. When belt 20 is tightened by overlapping longitudinal end portions 21 and 22 and connecting the overlapping longitudinal end portions in a manner to be described later, the pants or skirt 29 is supported against the waist of the wearer.

Outer lamina 23 has an outer surface facing away from the waist of a wearer and an intermediate surface that faces against an intermediate surface of inner lamina 24. The innermost belt surface that faces inward against the waist of a wearer is the innermost surface of inner lamina 24 when belt 20 is fitted around the waist of the wearer.

Longitudinal end portion 21 of belt 20 of the first embodiment is referred to as the male end portion of belt 20 because a male attachment member 50 is fixed thereto, and a series of closely spaced female attachment members 40 are fixed to the other longitudinal end portion 22 of belt 20, so that the second longitudinal end portion 22 is considered to be the female end portion of the belt. There is only one male attachment member 50 and a series of closely and uniformly spaced female attachment members 40 provided for the belt.

Figure 3:
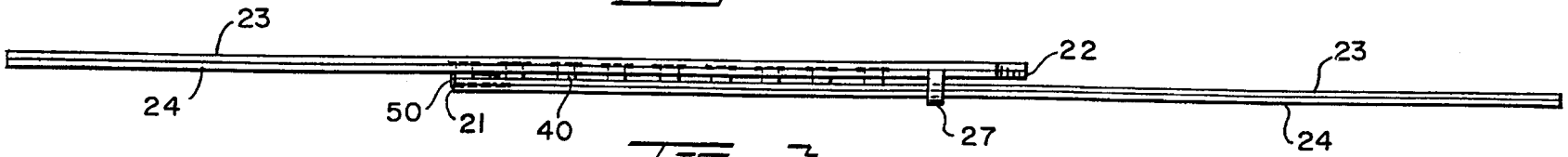
FIG. 3 is a top view of the overlapping belt portion of FIG. 2 with the attachment members shown in phantom relative to the outer and inner lamina of the belt.

When the belt is fitted around the waist of a wearer as depicted in FIG. 3, inner lamina 24 at male end portion 21 faces away from the waist of the wearer and toward inner lamina 24 at female end portion 22. Male end portion 21 threads through belt keeper 27 and immediately inside female end portion 22 as far as permitted by the girth of the wearer and then the single male attachment member 50 engages a selected one of female attachment members 40 located along the waist-facing surface of inner lamina 24 at male end portion 21 of belt 20.

Male end portion 21 is inserted behind female end portion 22 during this overlapping insertion. Therefore, female end portion 22 hides male attachment member 50 mounted on male end portion 21, and the exposed portions of female attachment members 40 face inward toward the waist of the wearer when the belt is locked in place around the waist of the wearer.

Each female member 40 has an upper base flange 42 and a lower base flange 43 of a staple-like structure fixed to an intermediate surface between lamina 23 and 24. A pair of intermediate cross members 44 and 45 extend through the thickness of inner lamina 24 to connect base flanges 42 and 43 with the ends of a bridge member 46 extending transversely of the width of belt 20 to form a narrow slot 41 between members 44, 45 and 46 and the surface of inner lamina 24 that faces toward the waist of the wearer when the belt end portions 21 and 22 overlap.

Male member 50 comprises a T-shaped base member 52 connected to the intermediate surface between outer lamina 23 and inner lamina 24, which base member 52 turns into a connecting member 53 extending through the thickness of inner lamina 24 near male end portion 21 to form a thin, narrow tongue 54 that extends lengthwise of the belt end portion 21 in closely spaced relation to an exposed major surface of inner lamina 24. The latter faces away from the waist of a wearer when the end portions 21 and 22 overlap as shown in FIG. 3. The simple construction of the belt in the overlapping region avoids the need for either a buckle or covering strap to hide any unsightly belt structure from the view of a person other than the belt wearer.

The dimensions of tongue 54 are so correlated with those of the narrow transversely extending slots 41 that the male end portion 21 of the belt can pass through belt keeper 27 and also into any narrow, transversely extending slot 41 between bridge member 46 and inner lamina 24 without unduly increasing the total thickness of the belt 20 in the overlapping region. The length of tongue 54 is slightly shorter than the distance between adjacent bridge members 46 of adjacent female connection members 40 to facilitate engaging tongue 54 with the proper slot 41 provided by a female attachment member 40 that cooperates with tongue 54 to adjust the length of belt 20 to conform to the waist of the wearer.

While the spacing between adjacent female attachment members 40 along the length of belt 20 can be selected over some range of values, it has been found acceptable to separate bridge members 46 by one half inch and to have a uniform spacing between adjacent bridge members. A sufficient belt inventory for most of the human population would require three different belt patterns for men and three different belt patterns for women instead of having a different size belt for each change of two inches of belt size. For example, a small men's size belt can accommodate waists of 30 to 35 inches, a medium men's belt size can accommodate waists of 34 to 39 inches and a large men's belt size can accommodate waists of 38 to 43 inches. Similarly, women's belts can be provided in size ranges of 26 to 31 inches, 30 to 35 inches and 34 to 39 inches.

Figure 10:
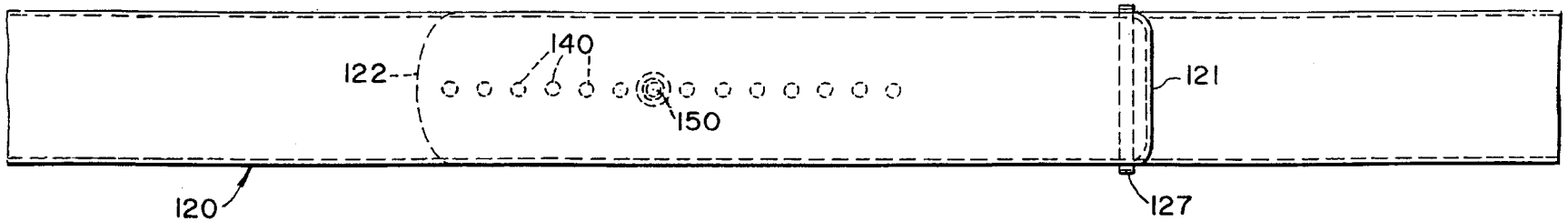
FIG. 10 is a view of overlapping end sections of a second embodiment of a belt conforming to this invention looking at the outermost surface of the belt when its male attachment member is supported within the thickness of the overlapping end portion of the belt and a plurality of closely spaced apertures of the female attachment member are shown in phantom.
Figure 11:
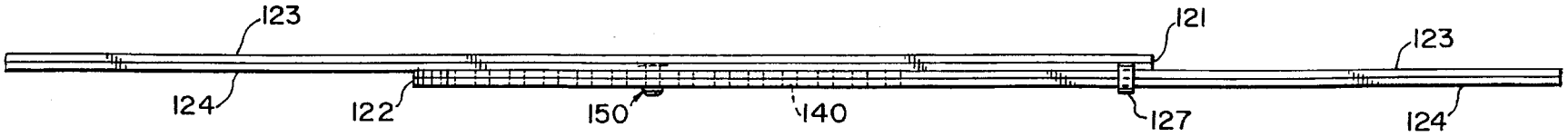
FIG. 11 is a top view of the overlapping end portion of the belt shown in frontal view in FIG. 10.
Figure 12:
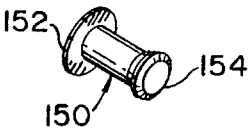
FIG. 12 is a perspective view of a first embodiment of pin forming part of the male attachment member of the second embodiment of this invention.

A second embodiment 120 of this invention contains reference numbers 100 units higher than those of the first embodiment and is illustrated in FIGS. 10 to 12. In this embodiment, the male end portion 121 of the belt 120 is provided with a pin 150 having a base 152 and a slightly enlarged head portion 154. Base 152 is attached to an intermediate surface between outer lamina 123 and inner lamina 124 and extends through the thickness of inner lamina 124 to its slightly enlarged head portion 154. The female end portion 122 of the belt is provided with a series of female engagement members in the form of closely spaced holes 140 extending throughout the thickness of female end portion 122. However, since the female end portion 122 is hidden from view when overlapped by male end portion 121 and both the holes 140 and head 154 of pin 150 face toward the waist of the wearer when end portions 121 and 122 overlap as shown in FIG. 11, all the unsightly structure of the overlapping portion of the belt is hidden from view of a person other than the belt wearer when the belt is tightened. As in the first embodiment, the total thickness of the belt does not increase unduly because of the lack of need for either a buckle or backward folding of either or both end portions of the belt that increases the bulk of the belt.

Although the invention need not be limited to exact figures, in the second embodiment, holes 140 can be as little as 1/16 inch in diameter spaced as little as one quarter inch apart.

The inclusion of a belt keeper 27 or 127 as part of the belt structure makes it possible to engage and align the male end portion and the female end portion of either embodiment of the belt with only one engagement between a male engagement member (tongue 54 or pin 150) and a female engagement member (40 or hole 140). This engagement is easier to accomplish than the double engagements of two male engagement members to two female engagement members required in the prior art.

Figure 4:
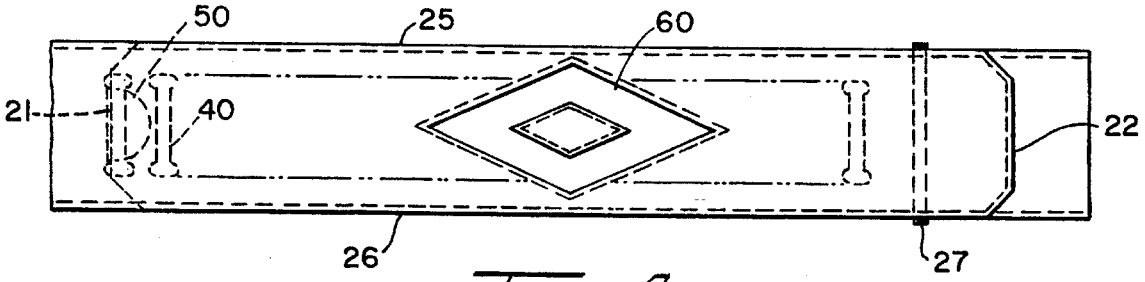
FIG. 4 is a partial frontal view of the overlapping portion of the belt shown in FIGS. 2 and 3 with ornamentation added to the outer surface of the outer lamina.
Figure 5:
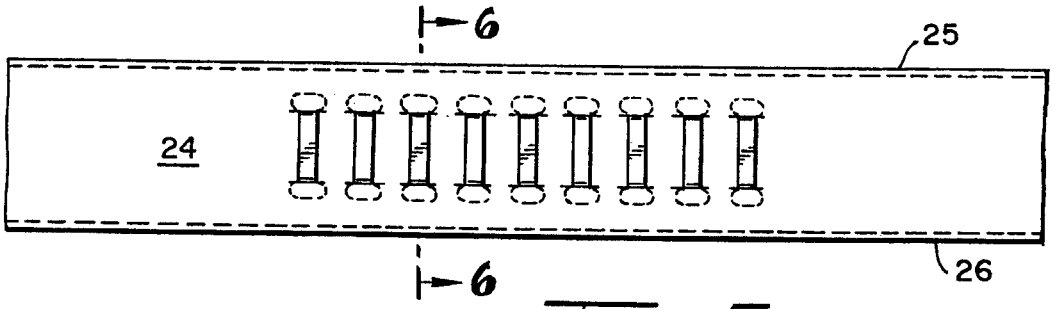
FIG. 5 is a frontal view of a surface of an inner lamina at a female end portion of the belt that supports a plurality of female attachment members or staples.
Figure 7:
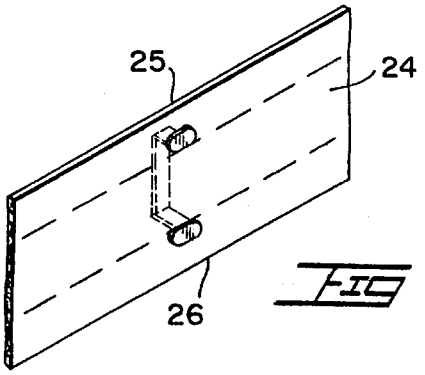
FIG. 7 is a perspective fragmentary view of the intermediate surface of an inner lamina at the female end portion of the belt to which top and bottom flanges of a base for a staple-like member that forms a female attachment member are fixed.
Figure 6:
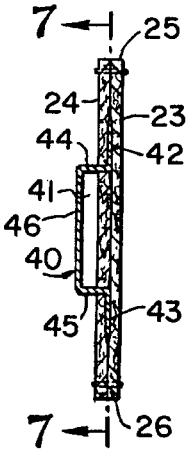
FIG. 6 is a sectional view across a female end portion of the belt of FIG. 1 taken along line 6—6 of FIG. 5.
Figure 8:
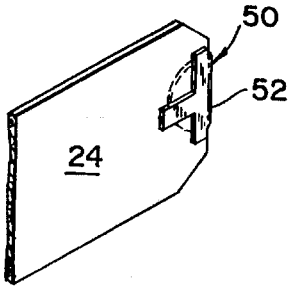
FIG. 8 is a perspective view of the inner lamina to which a T-shaped base (shown in full face) for the male attachment member is attached onto a male member (shown in phantom as a tongue).
Figure 9:
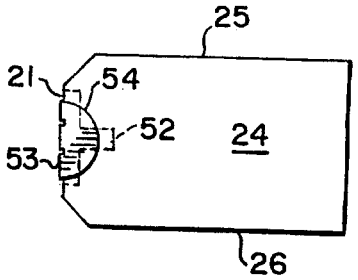
FIG. 9 is a plan view of an opposite surface of the inner lamina at the male end portion of the belt that supports the male attachment showing its thin elongated tongue in full face and its T-shaped base in phantom.

While the present invention does not require a buckle in the overlapping region where end portions 21 and 22 are engaged, there is still a desire on the part of the public to incorporate some type of ornamentation on a portion of the belt that faces away from the wearer. FIG. 4 shows an ornamentation 60 that is visible from the front surface of belt 20 that faces away from the waist of the wearer. Ornamentation 60 may either be fabricated out of or applied to the front surface or be in the form of an ornamental buckle of metal or plastic, for example, applied to belt 20 in the region of overlapping as in the prior art or in circumferentially spaced relation to the region of overlapping. This invention suggests an embodiment in which belt 20 is oriented relative to the waist of the wearer so that the overlapping region where overlapping end portions 21 and 22 engage each other is on one side of the wearer's waist and the ornamentation 60 is offset circumferentially from the region of overlapping to face forward from the waist of the wearer. A circumferential spacing of approximately 90 degrees is preferred.

Figure 13:
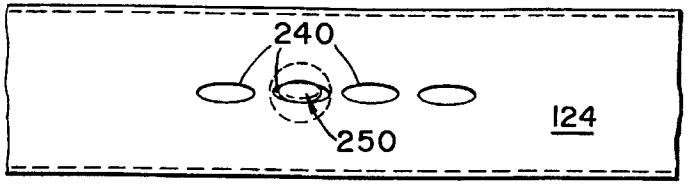
FIG. 13 is a fragmentary view similar to that of FIG. 10 showing a variation of the second embodiment of this invention in which the pin comprising the single male attachment member has an elliptical cross-section and the holes serving as the female attachment members have elliptical cross-sections to receive the pin of elliptical cross-section.

As shown in FIG. 13, a single male engagement member 250 having an elliptical cross-section may be substituted for pin 150 of the embodiment of FIGS. 11 to 13. In this case, apertures 240 of elliptical cross-section may replace the circular holes 140 of the second embodiment. The major axes of the elliptical apertures 240 should preferably extend longitudinally of the belt and conform in cross-section to that of male engagement member 250 to facilitate their engagement.

Figure 16:
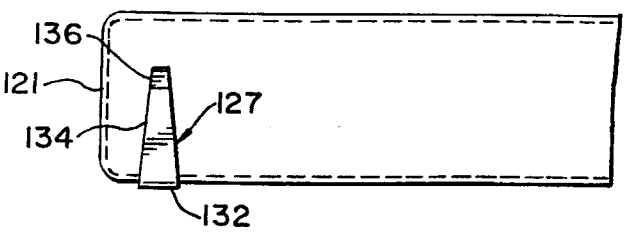
FIG. 16 is a view of the area of the belt shown in FIG. 15 looking away from the waist of the wearer.
Figure 15:
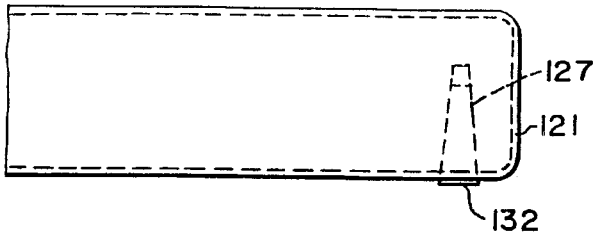
FIG. 15 is a front surface view of the belt in the vicinity of the belt keeper of FIG. 14 looking toward the waist of the wearer.
Figure 14:
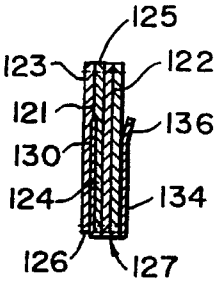
FIG. 14 is a cross-sectional view of a metal belt keeper showing its relation to the outer and inner lamina of the belt of this invention according to another embodiment.

The belt keeper 27 may be in the form of a fabric loop as shown in the first embodiment, but a metal U-shaped belt keeper 127 may also be used as shown in FIGS. 14, 15 and 16. The metal belt keeper 127 comprises a base 130 fixed near or at the interfacial surfaces between outer lamina 123 and inner lamina 124 at the male end portion 121 of belt 120 turning into a horizontal cross-piece 132 that extends toward a position occupied by a waist of a wearer and then upward to a vertical back piece 134 having a diverging upper portion 136. Metal belt keeper 127 is constructed and arranged for horizontal cross-piece 132 to receive lower edge 126 of belt 120 and vertical back piece 134 is located in a vertical plane behind inner lamina 124 of male belt end portion 121 to enable female end portion 122 to slide between male end portion 121 and vertical back piece 134 until the waist of the wearer allows pin 150 or 250 to be received in a hole 140 or opening 240 with end belt portions 121 and 122 in proper alignment.

The height of vertical back piece 134 is less than the width of belt 20 so that when bottom edge 26 of belt 20 rests on horizontal cross-piece 132, belt 20 hides metal belt keeper 127 from external view.

In summary, the belt of this invention is so constructed and arranged that when the belt end portions overlap, the engagement members and a metal belt keeper, if present, are hidden from view and only a single male engagement member is required in combination with a belt keeper to engage one of a series of female attachment members to provide the belt with a length suitable for the waist of the wearer and to maintain the end portions of the belt in suitable transverse alignment when the belt is tightened against the waist of the wearer.

Applicant has conformed to the requirements of the patent statutes by describing and illustrating what he considers to be the best embodiments of this invention. However, it is understood that various modifications within the scope of the claimed subject matter that follows may be made without departing from the gist of this invention.

What is claimed is:

1. A flexible belt having a front lamina and a rear lamina, said front lamina having a front surface that serves as the front surface of the belt and a rear surface that serves as a first intermediate surface of the belt and said rear lamina having a first surface that serves as a second intermediate surface of the belt and a rear surface that serves as an inner surface of the belt, attachment members comprising a single male attachment member fixed to a male end portion of the belt and a plurality of closely spaced female attachment members fixed to a female end portion of the belt to form a single attachment pair, said belt being free of any additional male attachment member or coupling means or folded portions that impart undesired bulkiness to the belt in the vicinity of either of said end portions and also free of any bulky structural elements that complicate the construction of the belt in the vicinity of said male end portion and said female end portion, a substantially entirely hidden belt keeper constructed and arranged to maintain said male end portion and said female end portion in transverse alignment where they overlap, said male end portion and said female end portion being so constructed and arranged that when they overlap, one of said end portions hides any attachment member extending from the other of said end portions and the other of said end portions carries at least one attachment member facing against the waist of a wearer when one of said end portions overlaps the other of said end portions so that all of said attachment members and said belt keeper are substantially entirely hidden from view by a person other than said wearer when said ends overlap.

2. A flexible belt as set forth in claim 1, wherein said male attachment member comprises a longitudinally extending tongue extending essentially parallel to and in closely spaced relation to said inner belt surface at said male end portion from a base fixed to an intermediate surface of the male end portion between said front lamina and said rear lamina and each of said female attachment members comprises a staple-like member fixed to an intermediate surface of said female end portion and having a bridge member closely spaced to said inner belt surface to form a transversely extending narrow slot constructed and arranged to receive said longitudinally extending tongue between said bridge member and the inner surface of said female end from which said plurality of closely spaced female connection members extend.

3. A flexible belt as set forth in claim 1, wherein said single male attachment member comprises a pin having a base member fixed to one of said intermediate surfaces at said male end portion and extends toward the waist of the wearer when said male end portion overlaps said female end portion and said female end portion has a series of closely spaced holes constructed and arranged to receive said pin of said male end portion extending toward said waist when said end portions overlap.

4. A flexible belt as in claim 1, wherein said belt keeper is metallic and comprises a metal base fixed to one of said belt end portions between said outer lamina and said inner lamina, a horizontal cross piece extending inward from said base and a vertical piece spaced inward from said one belt end portion a distance sufficient to receive an opposite belt end portion with its lower end portion supported on said horizontal cross piece, said vertical piece having a height less than the width of said belt to enable said inner lamina to hide said belt keeper from view when said male and female engagement members engage and said belt keeper aligns said end belt portions transversely.

5. A flexible belt as set forth in claim 1, further including ornamentation means constructed and arranged relative to said front surface of said front lamina overlap to expose said ornamentation means to a person facing said wearer when said belt is tightened about the waist of the wearer.

6. A flexible belt as set forth in claim 5, wherein said ornamentation means is circumferentially spaced along said belt from said overlapping end portions by approximately 90 degrees, whereby said ornamentation means faces forward when said overlapping end portions are applied against a side of the waist of the wearer.

* * * * *